US011011094B1

(12) United States Patent
Chen

(10) Patent No.: US 11,011,094 B1
(45) Date of Patent: May 18, 2021

(54) DISPLAY DEVICE WITH LOW POWER CONSUMPTION AND POLARITY INVERSION

(71) Applicant: GIANTPLUS TECHNOLOGY CO., LTD, Miaoli County (TW)

(72) Inventor: Wei-Yu Chen, Miaoli County (TW)

(73) Assignee: GIANTPLUS TECHNOLOGY CO., LTD, Miaoli County (TW)

( * ) Notice: Subject to any disclaimer, the term of this patent is extended or adjusted under 35 U.S.C. 154(b) by 0 days.

(21) Appl. No.: 17/072,045

(22) Filed: Oct. 16, 2020

(51) Int. Cl.
*G09G 3/20* (2006.01)
*G09G 3/36* (2006.01)

(52) U.S. Cl.
CPC ..... *G09G 3/20* (2013.01); *G09G 3/3607* (2013.01); *G09G 3/3614* (2013.01); *G09G 2310/0205* (2013.01); *G09G 2310/0213* (2013.01); *G09G 2310/0254* (2013.01); *G09G 2310/0264* (2013.01); *G09G 2310/08* (2013.01); *G09G 2330/021* (2013.01)

(58) Field of Classification Search
CPC ..... G02F 1/13306; G09G 2310/08; G09G 2330/021; G09G 2310/0213; G09G 3/3614; G09G 2310/0254; G09G 3/3607
See application file for complete search history.

(56) References Cited

U.S. PATENT DOCUMENTS

2005/0174310 A1* 8/2005 Huang ..... G09G 3/3614 345/87
2007/0001957 A1 1/2007 Moon et al.
2007/0013631 A1* 1/2007 Yang ..... G09G 3/3614 345/96
2008/0316159 A1* 12/2008 Qi ..... G09G 3/3677 345/92
2009/0058785 A1* 3/2009 Kim ..... G09G 3/3655 345/96
2015/0294611 A1* 10/2015 Zheng ..... G09G 3/2003 345/694
2016/0217754 A1* 7/2016 Bae ..... G09G 3/3614

FOREIGN PATENT DOCUMENTS

| | | |
|---|---|---|
| CN | 105467639 | 4/2016 |
| CN | 107991800 | 5/2018 |
| TW | I385451 | 2/2013 |
| TW | I518668 | 1/2016 |

* cited by examiner

*Primary Examiner* — Laurence J Lee
(74) *Attorney, Agent, or Firm* — JCIPRNET

(57) ABSTRACT

A display devices with better visual effects and low power consumption in inversion manners is provided. The display device includes a display panel and a driving circuit. The display panel includes scan lines, pixels, first common electrodes and second common electrodes. The second common electrodes and the first common electrodes are alternately arranged. The driving circuit provides a first common voltage to the first common electrodes and provides a second common voltage to the second common electrodes in a first time interval of a first frame time interval and a second time interval of a second frame time interval. In addition, the driving circuit provides the second common voltage to the first common electrodes, and provides the first common voltage to the second common electrodes in the first time interval of the second frame time interval and the second time interval of the first frame time interval.

13 Claims, 7 Drawing Sheets

DISPLAY DEVICE WITH LOW POWER CONSUMPTION AND POLARITY INVERSION

BACKGROUND

1. Technical Field

The disclosure related to a display device, and in particular, to a display device with low power consumption in polarity inversion manners.

2. Description of Related Art

With the advancement of electronic technology, display devices have become indispensable tools in people's lives. High-quality visual effects have become one of the essential elements in display devices.

In the current technology, the display panel can be driven by the display device by various types of inversion driving methods. However, in order to implement the dot inversion driving method or the row inversion driving method with better visual effects, frequent signal polarity conversions are often required. Therefore, an inversion driving method with better visual effects and low power consumption is an important issue for those skilled in the art.

SUMMARY

The display device with better visual effects and low power consumption in inversion manners is provided in the disclosure.

The display device of the disclosure includes a display panel and a driving circuit. The display panel includes a plurality of scan lines, a plurality of pixels, a plurality of first common electrodes, and a plurality of second common electrodes. The pixel rows in the pixels respectively correspond to the scan lines; the second common electrodes and the first common electrodes are alternately arranged. A driving circuit is coupled to the display panel. The driving circuit sequentially provides, in a first time interval of a first frame time interval and a first time interval of a second frame time interval, scan signals to odd-row scan lines in the scan lines; in the first time interval of the first frame time interval and a second time interval of the second frame time interval, a first common voltage to the first common electrodes, and a second common voltage to the second common electrodes. Moreover, the driving circuit further sequentially provides, in a second time interval of the first frame time interval and the second time interval of the second frame time interval, scan signals to even-row scan lines in the scan lines; in the second time interval of the first frame time interval and the first time interval of the second frame time interval, the second common voltage to the first common electrodes, and the first common voltage to the second common electrodes. The second common voltage is different from the first common voltage. The first time interval of the second frame time interval follows after the second time interval of the first frame time interval.

The display device of the disclosure includes a display panel and a driving circuit. The display panel includes a plurality of scan lines, a plurality of pixels, a plurality of first data lines, a plurality of second data lines, a plurality of first common electrodes, and a plurality of second common electrodes. The row subpixels in the subpixels correspond to the scan lines. The first common electrodes, together with the first data lines, collectively correspond to first subpixels in the subpixels. The second common electrodes, together with the second data lines, collectively correspond to a plurality of second subpixels in the subpixels. The second subpixels are alternately arranged with the first subpixels in a row direction and a column direction. A driving circuit is coupled to the display panel. The driving circuit sequentially provides, in a first frame time interval, a plurality of scan signals to the scan lines, a first common voltage to the first common electrodes, and a second common voltage to the second common electrodes. Moreover, the driving circuit sequentially provides, in a second frame time interval, the scan signals to the scan lines, the second common voltage to the first common electrodes, and the first common voltage to the second common electrodes. The second common voltage is different from the first common voltage. In addition, the second subpixels in first-column subpixels and the second subpixels in a second-column subpixels collectively correspond to one of the second data lines, and the first subpixels in the second-column subpixels and the first subpixels in a third-column subpixels collectively correspond to one of the first data lines.

In summary, the disclosure provides a display device in which, based on the arrangement relationship among the pixels, the first common electrodes, and the second common electrodes of the display panel, and the signal timing provided by the driving circuit to the scan lines, the first common electrodes, and the second common electrodes, the inversion driving is implemented. To implement the dot inversion driving or the column inversion driving, the driving circuit needs to convert the voltages of the first common electrodes and the second common electrodes only once or twice in a single frame time interval. In this way, the display device with better visual effects and low power consumption in inversion manners is provided in the disclosure.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
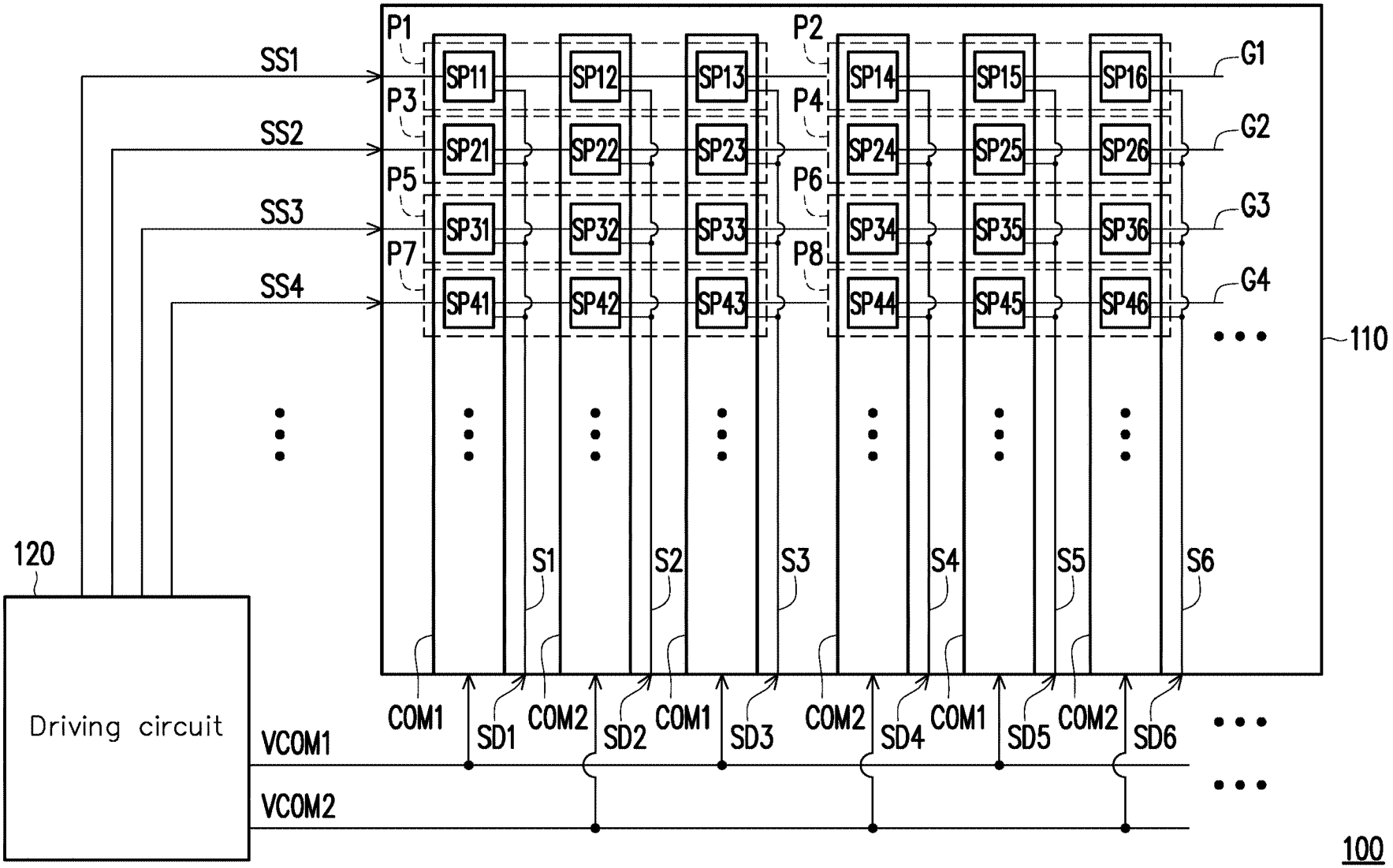
FIG. 1 is a schematic diagram of a display device according to a first embodiment of the disclosure.

Some of the embodiments of the disclosure will be described in detail in conjunction with the accompanying drawings. The same reference numbers are used in the drawings and the description to refer to the same or like parts. These embodiments are only a part of the disclosure, and do not disclose all the practicable ways of the disclosure.

To be more precise, these embodiments are only examples in the scope of the claims of the disclosure.

Please refer to FIG. 1. FIG. 1 is a schematic diagram of a display device according to the first embodiment of the disclosure. In the present embodiment, the display device 100 includes a display panel 110 and a driving circuit 120. The display panel 110 includes scan lines G1-G4, pixels P1-P8, a plurality of first common electrodes COM1, and a plurality of second common electrodes COM2. In order to facilitate the description of the spirit of the disclosure, 4 scan lines G1-G4 and 8 pixels P1-P8 are used as examples in the present embodiment. The disclosure is not limited to the number of scan lines G1-G4 and the number of pixels P1-P8 in the present embodiment. In the present embodiment, the first common electrodes COM1 and the second common electrodes COM2 are alternately arranged, respectively. The first common electrodes COM1 collectively receive a common voltage signal VCOM1. Correspondingly, the second common electrodes COM2 collectively receive a common voltage signal VCOM2. A plurality of row pixels in the pixels P1-P8 correspond to the scan lines G1-G4 respectively. For example, the pixel P1 and the pixel P2 are respectively a row pixel corresponding to the scan line G1; the pixel P3 and the pixel P4 are respectively a row pixel corresponding to the scan line G2, and so on. The scan lines G1-G4 are configured to receive scan signals SS1-SS4 respectively. For example, the scan line G1 is configured to receive the scan signal SS1, the scan line G2 is configured to receive the scan signal SS2, and so on.

In the present embodiment, the driving circuit 120 is coupled to the display panel 110. In a first time interval of a first frame time interval and the first time interval of a second frame time interval, the driving circuit 120 sequentially provides the scan signals SS1 and SS3 to the odd scan lines (i.e. the scan line G1 and the scan line G3) in the scan lines G1-G4. In the first time interval of the first frame time interval and the second time interval of the second frame time interval, the driving circuit 120 further provides the common voltage signal VCOM1 having a first common voltage to the first common electrodes COM1, and the common voltage signal VCOM2 having a second common voltage to the second common electrodes COM2. In the present embodiment, the first common voltage is different from the second common voltage. The first common voltage and the second common voltage are represented as having opposite polarities.

In addition, in the second time interval of the first frame time interval and the second time interval of the second frame time interval, the driving circuit 120 sequentially provides the scan signal SS2 and the scan signal SS4 to the scan lines of even rows (i.e. the scan line G2 and the scan line G4) of the scan lines G1-G4. In the second time interval of the first frame time interval and the first time interval of the second frame time interval, the driving circuit 120 further provides the common voltage signal VCOM1 having the second common voltage to the first common electrodes COM1, and the common voltage signal VCOM2 having the first common voltage to the second common electrodes COM2. In the first frame time interval and the second frame time interval, the second time interval follows after the first time interval. The first time interval of the second frame time interval follows after the second time interval of the first frame time interval.

Figure 2:
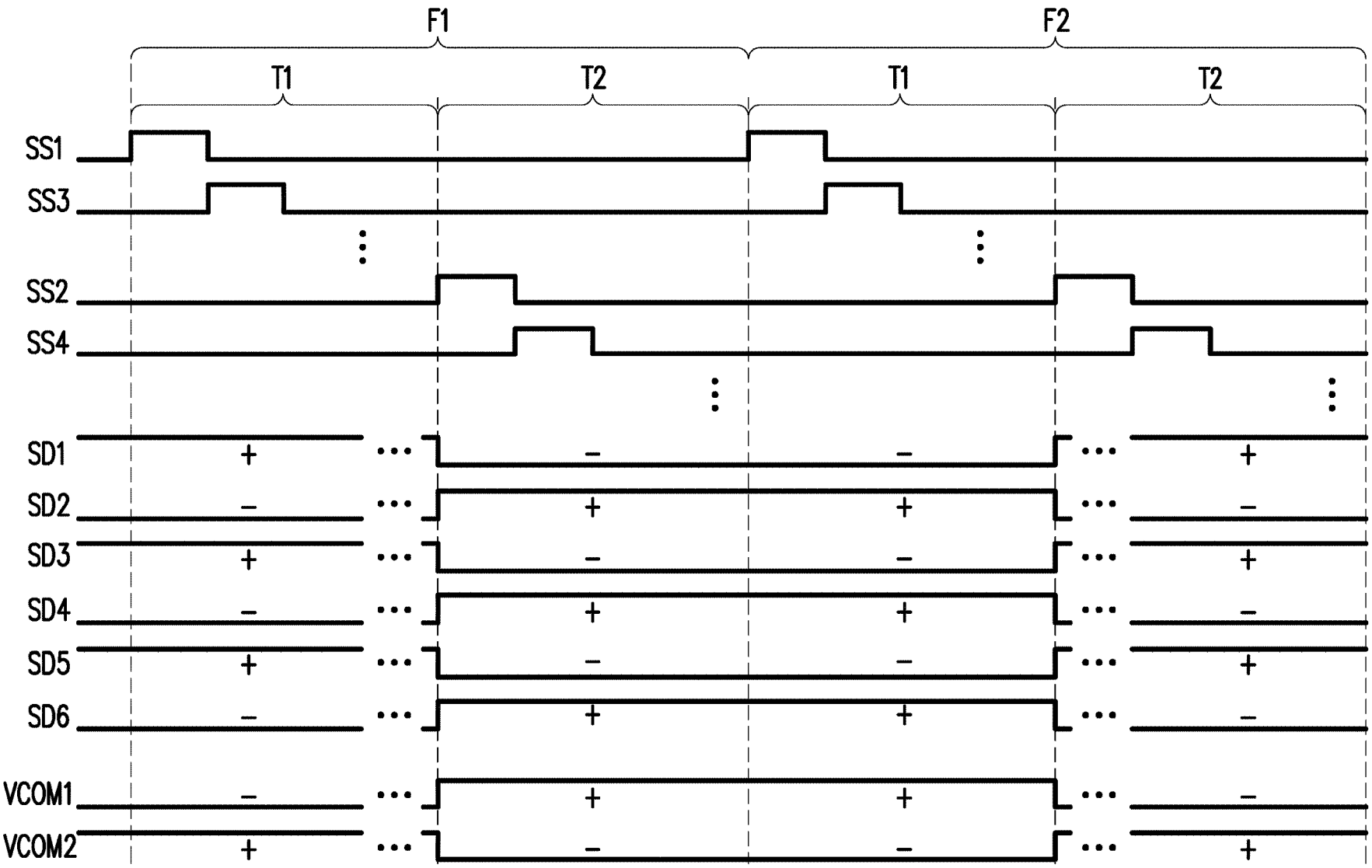
FIG. 2 is a signal timing diagram drawn according to the disclosure.

Please refer to FIG. 1 and FIG. 2 at the same time. FIG. 2 is a signal timing diagram drawn according to the disclosure. In the present embodiment, the pixels P1-P8 respectively include a plurality of subpixels. For example, the pixel P1 includes three subpixels SP11-SP13. The pixel P2 includes three subpixels SP14-SP16. Likewise, the pixel P8 includes three subpixels SP44-SP46. However, the disclosure is not limited to the number of subpixels of the pixels P1-P8.

In the present embodiment, the first common electrodes COM1 respectively correspond to odd-column subpixels in the subpixels SP11-SP46. The second common electrodes COM2 respectively correspond to even-column subpixels in the subpixels SP11-SP46. In the present embodiment, the disposition of data lines S1-S6 is substantially similar to the disposition of the first common electrodes COM1 and the second common electrodes COM2. For example, the data line S1 corresponds to first-column subpixels in the subpixels SP11-SP46, the data line S2 corresponds to second-column subpixels in the subpixels SP11-SP46, and so on. The data lines S1-S6 receive the data signals SD1-SD6 respectively. For example, the data lines S1 receives the data signal SD1 respectively, the data lines S2 receives the data signal SD2 respectively, and so on.

In a first time interval T1 of a frame time interval F1, the driving circuit 120 sequentially provides the scan signals SS1 and SS3 to the odd-row scan lines G1 and G3 in the scan lines, such that the subpixels SP11-SP16 and SP31-SP36 are selected in sequence. The driving circuit 120 also provides the common voltage signal VCOM1 having the first common voltage (for example, 0 volts, but the disclosure is not limited thereto) to the first common electrodes COM1, and the common voltage signal VCOM2 having the second common voltage (for example, 5 volts, but the disclosure is not limited thereto) to the second common electrodes COM2. Moreover, in the first time interval T1, the driving circuit 120 also provides data signals SD1-SD6 to each column subpixel, respectively. For example, the data signal SD1 is provided to the first-column subpixels (i.e. subpixels SP11, SP21, SP31, and SP41) via a data line S1. The data signal SD2 is provided to a second-column subpixels (i.e. subpixels SP12, SP22, SP32, and SP42) via a data line S2. It should be noted that based on a polarity conversion of the common voltage signal VCOM1 and the common voltage signal VCOM2, the polarities of the data signal SD1 received by the first-column subpixels are opposite to the polarities of the data signal SD2 received by the second-column subpixels; the polarities of the data signal SD2 received by the second-column subpixels is opposite to the polarities of the data signal SD3 received by a third-column subpixels (i.e. subpixels SP13, SP23, SP33, and SP43); and so on. The polarities of the data signal SD1, the data signal SD3, and the data signal SD5 are opposite to the polarities of the data signal SD2, the data signal SD4, and the data signal SD6. Therefore, in the row direction, adjacent subpixels are respectively provided with the data signals having the opposite polarities.

In a second time interval T2 of the first frame time interval F1, the driving circuit 120 sequentially provides the scan signals SS2 and SS4 to the even-row scan lines G2 and G4 in the scan lines, such that the subpixels SP21-SP26 and SP41-SP46 are selected in sequence. The driving circuit 120 also provides the common voltage signal VCOM1 having the second common voltage to the first common electrodes COM1, and the common voltage signal VCOM2 having the first common voltage to the second common electrodes COM2. Further, in the second time interval T2, the driving circuit 120 also provides the data signal SD1-SD6 inverted to each column subpixel, respectively. Similar to the first time interval T1, in the row direction, adjacent subpixels are respectively provided with the data signals having opposite polarities. Therefore, the polarities of adjacent subpixels in the row direction and the column direction are opposite to each other.

Following after the second time interval T2 of the first frame time interval F1, in the first time interval T1 of a second frame time interval F2, the driving circuit 120 sequentially provides the scan signals SS1 and SS3 to the scan lines G1 and G3, such that the subpixels SP11-SP16 and SP31-SP36 are selected in sequence. The driving circuit 120 also provides the common voltage signal VCOM1 having the second common voltage to the first common electrodes COM1, and the common voltage signal VCOM2 having the first common voltage to the second common electrodes COM2. Moreover, in the first time interval T1 of the second frame time interval F2, the driving circuit 120 also provides the data signals SD1-SD6 to each column subpixel, respectively. The polarities of the data signals SD1-SD6 in the first time interval T1 of the second frame time interval F2 are respectively the same as the polarities of the data signals SD1-SD6 in the second time interval T2 of the first frame time interval F1.

In the second time interval T2 of the second frame time interval F2, the driving circuit 120 sequentially provides the scan signals SS2 and SS4 to the scan lines G2 and G4, such that the subpixels SP21-SP26 and SP41-SP46 are selected in sequence. The driving circuit 120 also provides the common voltage signal VCOM1 having the first common voltage to the first common electrodes COM1, and the common voltage signal VCOM2 having the second common voltage to the second common electrodes COM2. Moreover, in the second time interval T2 of the second frame time interval F2, the driving circuit 120 also provides the data signals SD1-SD6 to each column subpixel, respectively. The polarities of adjacent subpixels in the row direction and the column direction are opposite to each other. It should be noted that the polarities of the data signals SD1-SD6 in the second time interval T2 of the second frame time interval F2 are respectively the same as the polarities of the data signals SD1-SD6 in the first time interval T1 of the first frame time interval F1. The polarities of the data signals SD1-SD6 in the second time interval T2 of the second frame time interval F2 are respectively opposite to the polarities of the data signals SD1-SD6 in the first time interval T1 of the second frame time interval F2. Therefore, in the frame time interval F1 and the frame time interval F2, a dot (subpixel) inversion driving with better visual effects is provided by the display device 100.

In the present embodiment, the driving circuit 120 may be a circuit including a gate driver, a source driver, and a timing controller.

It is worth mentioning here that in the frame time interval F1 and the frame time interval F2, A cycle in which the display device 100 performs a polarity conversion of the common voltage signals VCOM1, VCOM2, and the data signals SD1-SD6 is equivalent to a time length of a single frame time interval. In other words, a dot inversion driving may be implemented by performing the polarity conversion only once in a single frame time interval by the display device 100. In this way, the display device 100 can provide a dot inversion driving with low power consumption.

Figure 3:
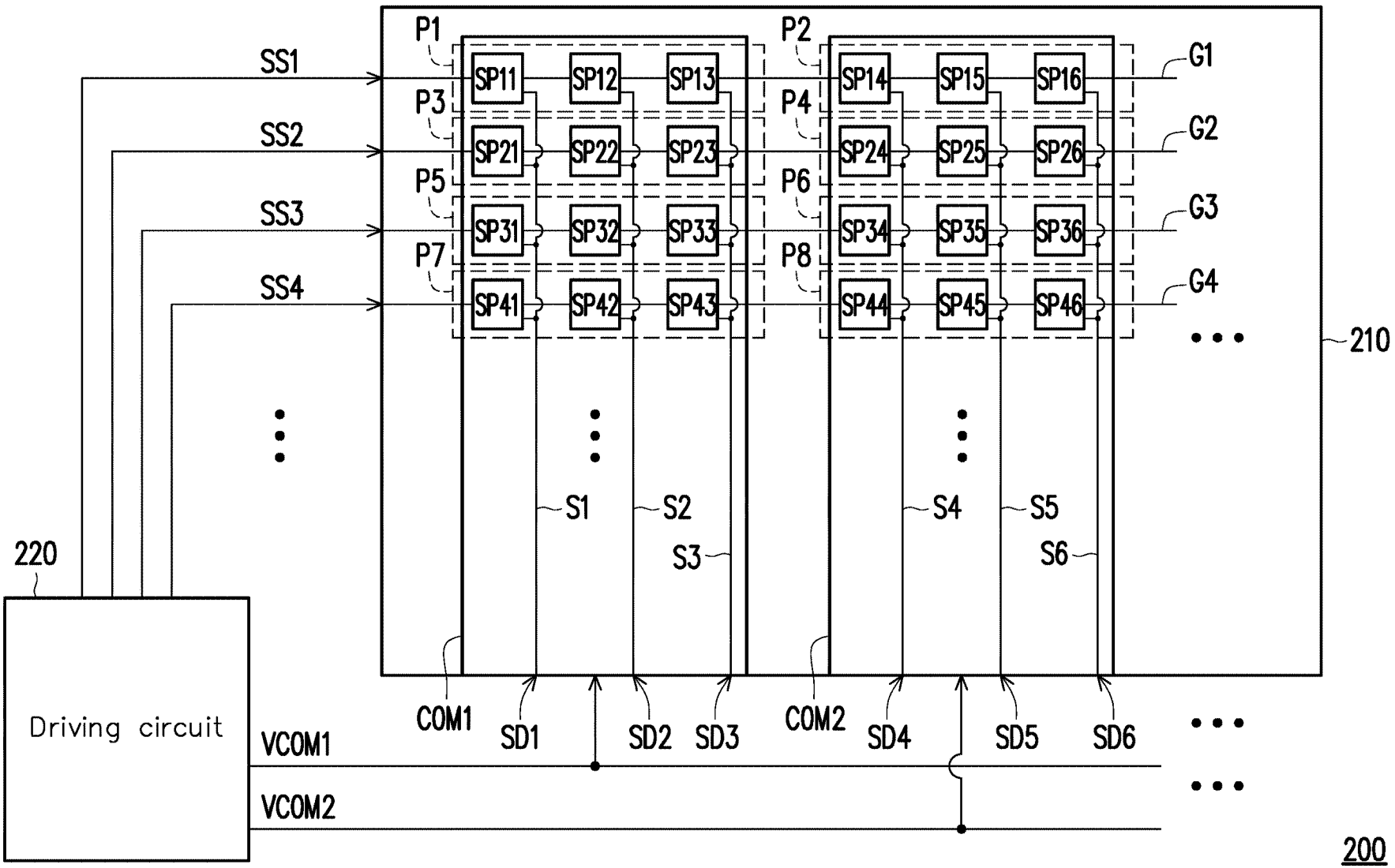
FIG. 3 is a schematic diagram of a display device according to a second embodiment of the disclosure.
Figure 4:
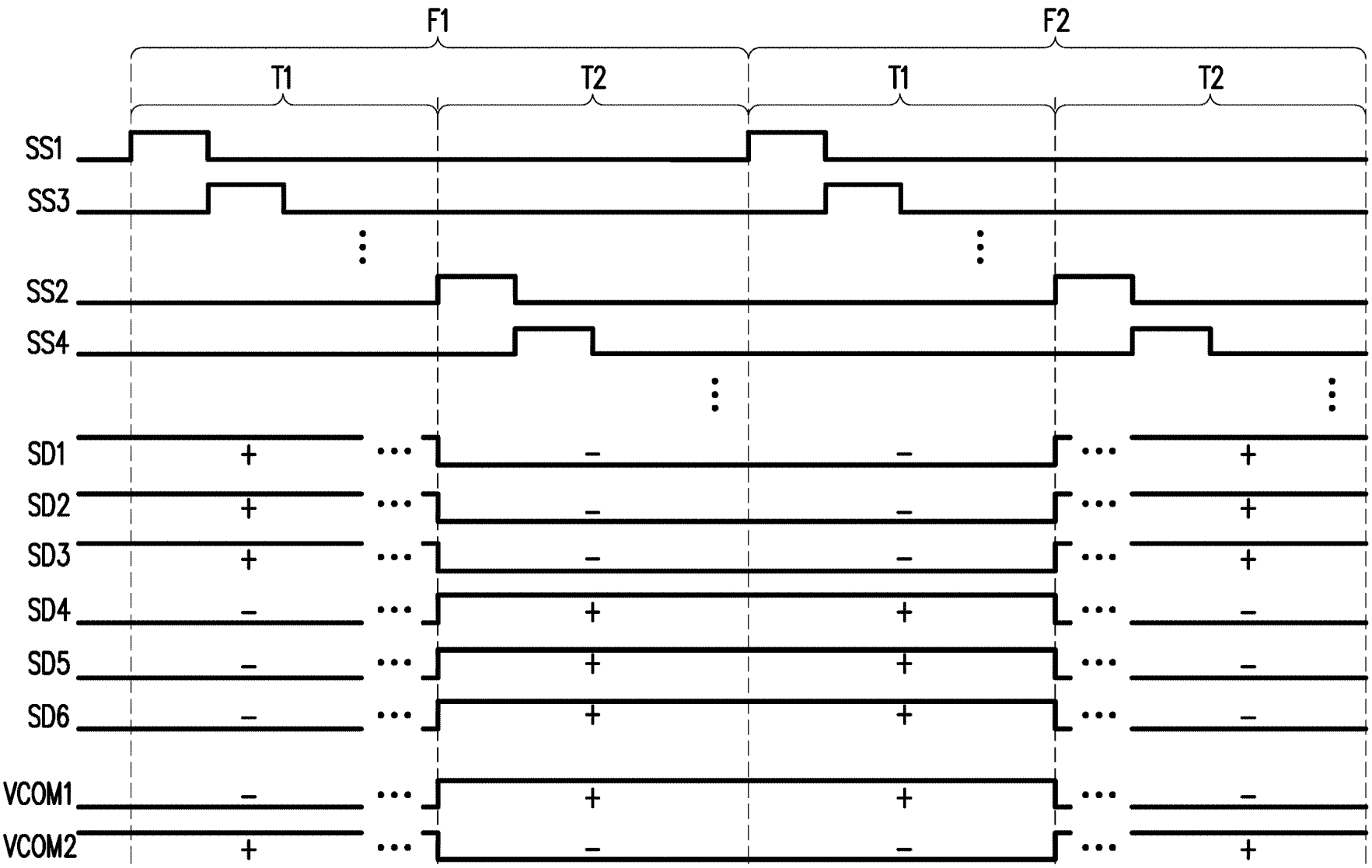
FIG. 4 is another signal timing diagram according to the disclosure.

Please refer to FIG. 3 and FIG. 4. FIG. 3 is a schematic diagram of a display device according to the second embodiment of the disclosure. FIG. 4 is another signal timing diagram according to the disclosure. In the present embodiment, the display device 200 includes a display panel 210 and a driving circuit 220. Difference from the display panel 110 of the first embodiment, the first common electrodes COM1 of the display panel 210 respectively correspond to odd-column pixels (i.e. pixels P1, P3, P5, and P7), and the second common electrodes COM2 respectively correspond to even-column pixels (i.e. pixels P2, P4, P6, and P8).

In the first time interval T1 of the first frame time interval F1, the driving circuit 220 sequentially provides the scan signals SS1 and SS3 to the scan lines G1 and G3, such that the subpixels SP11-SP16 and SP31-SP36 are selected in sequence. The driving circuit 220 also provides the common voltage signal VCOM1 having the first common voltage to the first common electrodes COM1, and the common voltage signal VCOM2 having the second common voltage to the second common electrodes COM2. Moreover, in the first time interval T1, the driving circuit 220 also provides the data signals SD1-SD6 to each column subpixel, respectively. In the present embodiment, the subpixels in the odd-column pixels are provided with the data signals SD1-SD3 having the same polarities. The subpixels in the even-column pixels are provided with the data signals SD4-SD6 having the same polarities. That is, in the row direction, the subpixels corresponding to the same pixel are provided with the data signals having the same polarities. The polarities of the data signals SD1-SD3 are opposite to the polarities of the data signals SD4-SD6. In other words, in the row direction, adjacent pixels are respectively provided with the data signals having opposite polarities.

In a second time interval T2 of the first frame time interval F1, the driving circuit 220 sequentially provides the scan signals SS2 and SS4 to the scan lines G2 and G4, such that the subpixels SP21-SP26 and SP41-SP46 are selected in sequence. The driving circuit 220 also provides the common voltage signal VCOM1 having the second common voltage to the first common electrodes COM1, and the common voltage signal VCOM2 having the first common voltage to the second common electrodes COM2. Further, in the second time interval T2, the driving circuit 220 also provides the data signals SD1-SD6 inverted to each column subpixel, respectively. Similar to the first time interval T1, the subpixels in the odd-column pixels are provided with the data signals SD1-SD3 having the same polarities. The subpixels in the even-column pixels are provided with the data signals SD4-SD6 having the same polarities. The polarities of the data signals SD1-SD3 are opposite to the polarities of the data signals SD4-SD6. In the column direction and the row direction, adjacent pixels respectively correspond to opposite signal polarities.

Following after the second time interval T2 of the first frame time interval F1, in the first time interval T1 of the second frame time interval F2, the driving circuit 220 sequentially provides the scan signals SS1 and SS3 to the scan lines G1 and G3, such that the subpixels SP11-SP16 and SP31-SP36 are selected in sequence. The driving circuit 220 also provides the common voltage signal VCOM1 having the second common voltage to the first common electrodes COM1, and the common voltage signal VCOM2 having the first common voltage to the second common electrodes COM2. Moreover, in the second time interval T2 of the second frame time interval F2, the driving circuit 220 also provides the data signals SD1-SD6 inverted to each column subpixel, respectively. The polarities of the data signals SD1-SD6 in the first time interval T1 of the second frame time interval F2 are respectively the same as the polarities of the data signals SD1-SD6 in the second time interval T2 of the first frame time interval F1.

In the second time interval T2 of the second frame time interval F2, the driving circuit 120 sequentially provides the scan signals SS2 and SS4 to the scan lines G2 and G4, such that the subpixels SP21-SP26 and SP41-SP46 are selected in sequence. The driving circuit 120 also provides the common voltage signal VCOM1 having the first common voltage to the first common electrodes COM1, and the common voltage signal VCOM2 having the second common voltage to the second common electrodes COM2. Moreover, in the second time interval T2 of the second frame time interval F2, the driving circuit 120 also provides the data signals SD1-SD6 to each column subpixel, respectively. The polarities of adjacent pixels in the row direction and the column direction are opposite to each other. The polarities of the data signals SD1-SD6 in the second time interval T2 of the second frame time interval F2 are the same as the polarities of the data signals SD1-SD6 in the first time interval T1 of the first frame time interval F1, and are respectively opposite to the polarities of the data signals SD1-SD6 in the first time interval T1 of the second frame time interval F2. Therefore, in the frame time interval F1 and the frame time interval F2, a dot (pixel) inversion driving with better visual effects is provided by the display device 200.

It is worth mentioning here that a dot inversion driving may be implemented by performing the polarity conversion only once in a single frame time interval by the display device 200. In this way, the display device 200 can provide a dot inversion driving with low power consumption.

Figure 5:
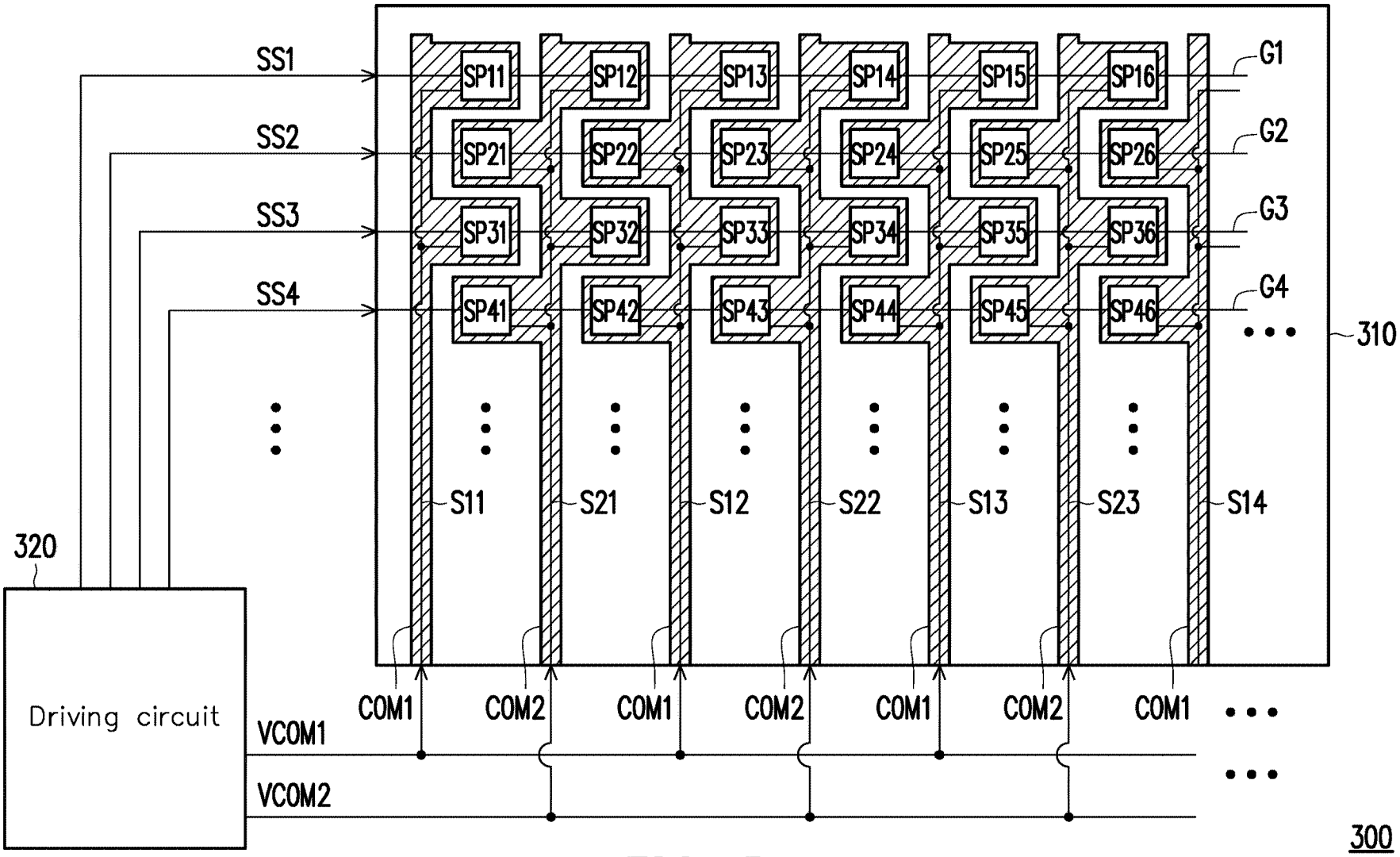
FIG. 5 is a schematic diagram of a display device according to a third embodiment of the disclosure.

Please refer to FIG. 5. FIG. 5 is a schematic diagram of a display device according to the third embodiment of the disclosure. In the present embodiment, the display device 300 includes a display panel 310 and a driving circuit 320. The display panel 310 includes the scan lines G1-G4; the subpixels SP11-SP46; the first data lines S11, S12, S13, S14; the second data lines S21, S22, S23; a plurality of first common electrodes COM1; and a plurality of second common electrodes COM2. For example, in the subpixel SP11-SP46, the subpixel SP11-SP13 may be regarded as one pixel (such as the pixel P1 in FIG. 1), the subpixel SP14-SP16 may be regarded as one pixel (such as the pixel P2 in FIG. 1), and so on. In the present embodiment, the subpixels SP11-SP46 in the row pixels correspond to the scan lines G1-G4 respectively. For example, the subpixel SP11-SP16 are respectively a row pixel corresponding to the scan line G1, the subpixels SP21-SP26 are respectively another row pixel corresponding to the scan line G2, and so on. The scan lines G1-G4 are configured to receive scan signals SS1-SS4 respectively.

In the present embodiment, the subpixels SP11-SP46 are divided into a plurality of first subpixels and a plurality of second subpixels. The second subpixels are alternately arranged with the first subpixels in the row direction and the column direction. For example, the subpixels SP11, SP13, SP15, SP22, SP24, SP26, SP31, SP33, SP35, SP42, SP44, and SP46 are the first subpixels. The subpixels SP12, SP14, SP16, SP21, SP23, SP25, SP32, SP34, SP36, SP41, SP43, and SP45 are the second subpixels. In the present embodiment, the first common electrodes COM1 correspond to the first subpixels. The second common electrodes COM2 correspond to the second subpixels. In the present embodiment, the first common electrodes COM1 and the first data lines S11, S12, S13, and S14 correspond to at least one first subpixel. The second common electrodes COM2 and the second data lines S21, S22, S23 correspond to at least one second subpixel. For example, the first subpixels SP11, SP31 in a first-column subpixels collectively correspond to the first data lines S11. The second subpixels SP21, SP41 in the first-column subpixels and the second subpixels SP12, SP32 in a second-column subpixels collectively correspond to the second data lines S21. The first subpixels SP22, SP42 in the second-column subpixels and the first subpixels SP13, SP33 in a third-column subpixels collectively correspond to the first data lines S12, and so on.

In the present embodiment, the first common electrodes COM1 and the second common electrodes COM2 extend in the column direction. For example, the first subpixels SP11, SP31 in the first-column subpixels collectively correspond to a single first common electrode COM1. the second subpixels SP21, SP41 in the first-column subpixels and the second subpixels SP12, SP32 in the second-column subpixels collectively correspond to a single second common electrode COM2. The first subpixels SP22, SP42 in the second-column subpixels and the first subpixels SP13, SP33 in the third-column subpixels collectively correspond to another single first common electrode COM1, and so on. However, the first common electrodes COM1 and the second common electrodes COM2 of the disclosure are not limited to the present embodiment. In some embodiments, the first subpixels of a same column collectively correspond to the same first common electrode COM1. The subpixels of the same column subpixels collectively correspond to the same second common electrode COM2.

In other words, in the present embodiment, the supply method of the data signal corresponds to the supply method of the common voltage signal VCOM1 and the common voltage signal VCOM2. It should be noted that the polarities of the data signals received by the first data lines S11, S12, S13, S14 (as shown in the data signals SD1, SD3, SD5 in FIG. 1) are opposite to the polarities of the data signals received by the second data lines S21, S22, S23 (as shown in the data signals SD2, SD4, and SD6 in FIG. 1). That is, the polarities of the data signals received by the first subpixels are opposite to the polarities of the data signals respectively received by the second subpixels.

Please refer to FIG. 2 and FIG. 5 at the same time. In the present embodiment, the third embodiment is applicable to the signal timing diagram shown in FIG. 2. It can be seen that the operation timing of a driving circuit 320 of a display device 300 is similar to the operation timing of the driving circuit 120 of the first embodiment. The operation timing of the present embodiment is sufficiently taught in the embodiment of FIG. 2, and will not be repeated here. Based on the signal timing diagram of FIG. 2, a column (column subpixel) inversion driving may be implemented by performing the polarity conversion only once in a single frame time interval by the display device 300. In this way, the display device 300 can provide a column inversion driving with low power consumption.

Figure 6:
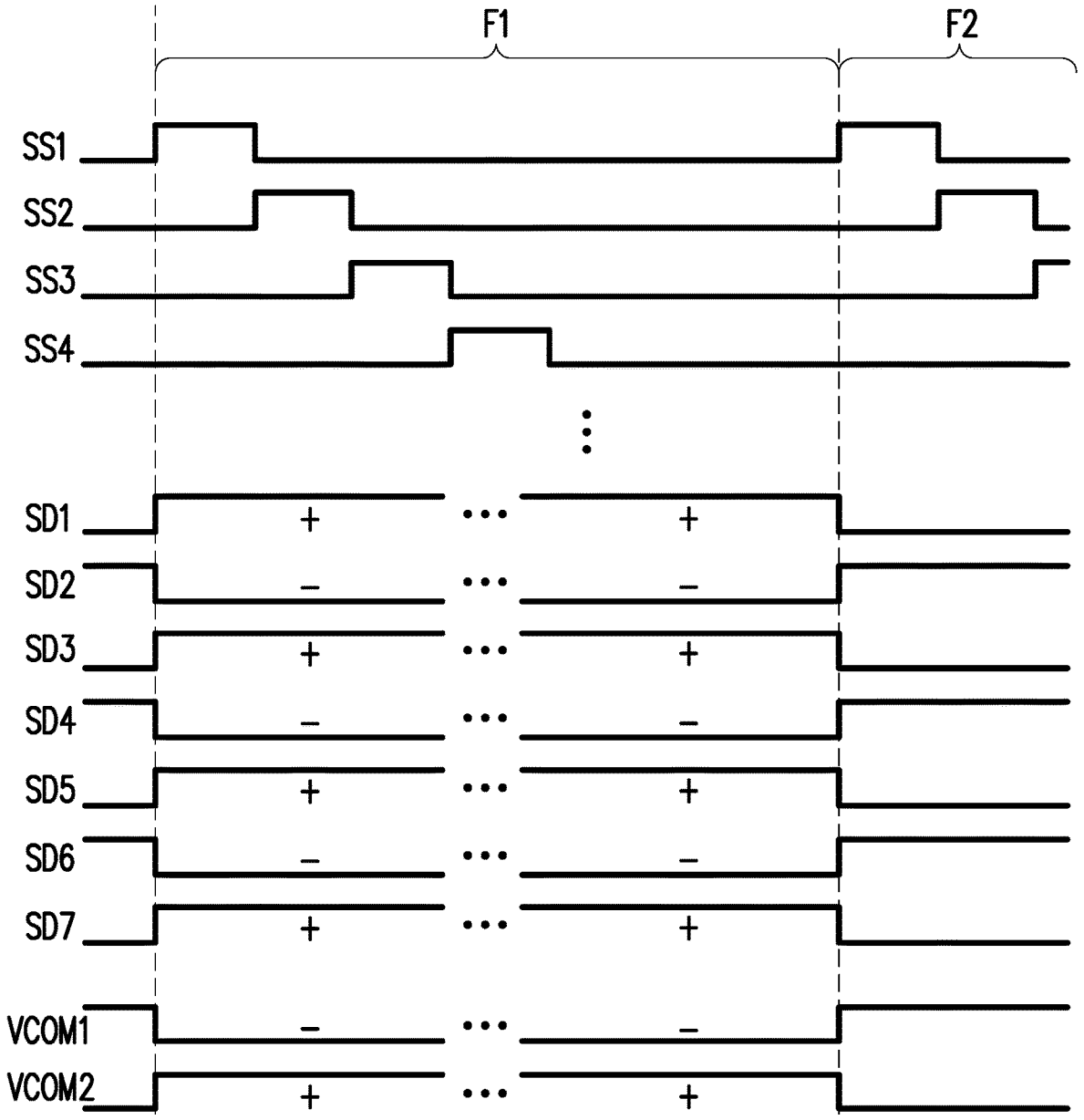
FIG. 6 is yet another signal timing diagram according the disclosure.

Please refer to FIG. 5 and FIG. 6 at the same time. FIG. 6 is yet another signal timing diagram according to the disclosure. The third embodiment is applicable to the signal timing diagram shown in FIG. 6. In the present embodiment, in the first frame time interval F1, the driving circuit 320 sequentially provides scan signals SS1-SS4 to the scan lines G1-G4. In the first frame time interval F1, the driving circuit 320 also provides the common voltage signal VCOM1 having a first common voltage to the common electrodes COM1, and the common voltage signal VCOM2 having a second common voltage to the second common electrodes COM2. Moreover, in the first frame time interval F1, the driving circuit 320 also provides data signals SD1-SD7 to each subpixel. For example, the data signal SD1 is provided to the subpixel SP11 and the subpixel SP31; the data signal SD2 is provided to the subpixels SP12, SP21, SP32, and SP41; the data signal SD3 is provided to the subpixels SP13, SP22, SP33, and SP42; and so on. In other words, the supply of method the data signals SD1-SD7 corresponds to the supply of method the common voltage signal VCOM1 and the common voltage signal VCOM2. It should be noted that the polarities of the data signals SD1, SD3, SD5, and SD7 received by the first subpixels are opposite to the polarities of the data signals SD2, SD4, and SD6 respectively received by the second subpixels.

In the second frame time interval F2, the driving circuit 320 sequentially provides the scan signals SS1-SS4 to the scan lines G1-G4. In the second frame time interval F2, the driving circuit 320 also provides the common voltage signal VCOM1 having the second common voltage to the common electrodes COM1, and the common voltage signal VCOM2 having the first common voltage to the second common electrodes COM2. Further, in the second frame time interval F2, the driving circuit 320 also provides the data signals SD1-SD7 inverted to each column subpixel, respectively. Therefore, in the frame time interval F1 and the time interval F2, a dot (subpixel) inversion driving with better visual effects may be performed by the display device 300.

It is worth mentioning here that the display device 300 performs the polarity conversion of the common voltage signals VCOM1, VCOM2 and the data signals SD1-SD6 only once during each of the frame time interval F1 and the fame time interval F2. In this way, the display device 300 can provide a dot inversion driving with low power consumption.

Figure 7:
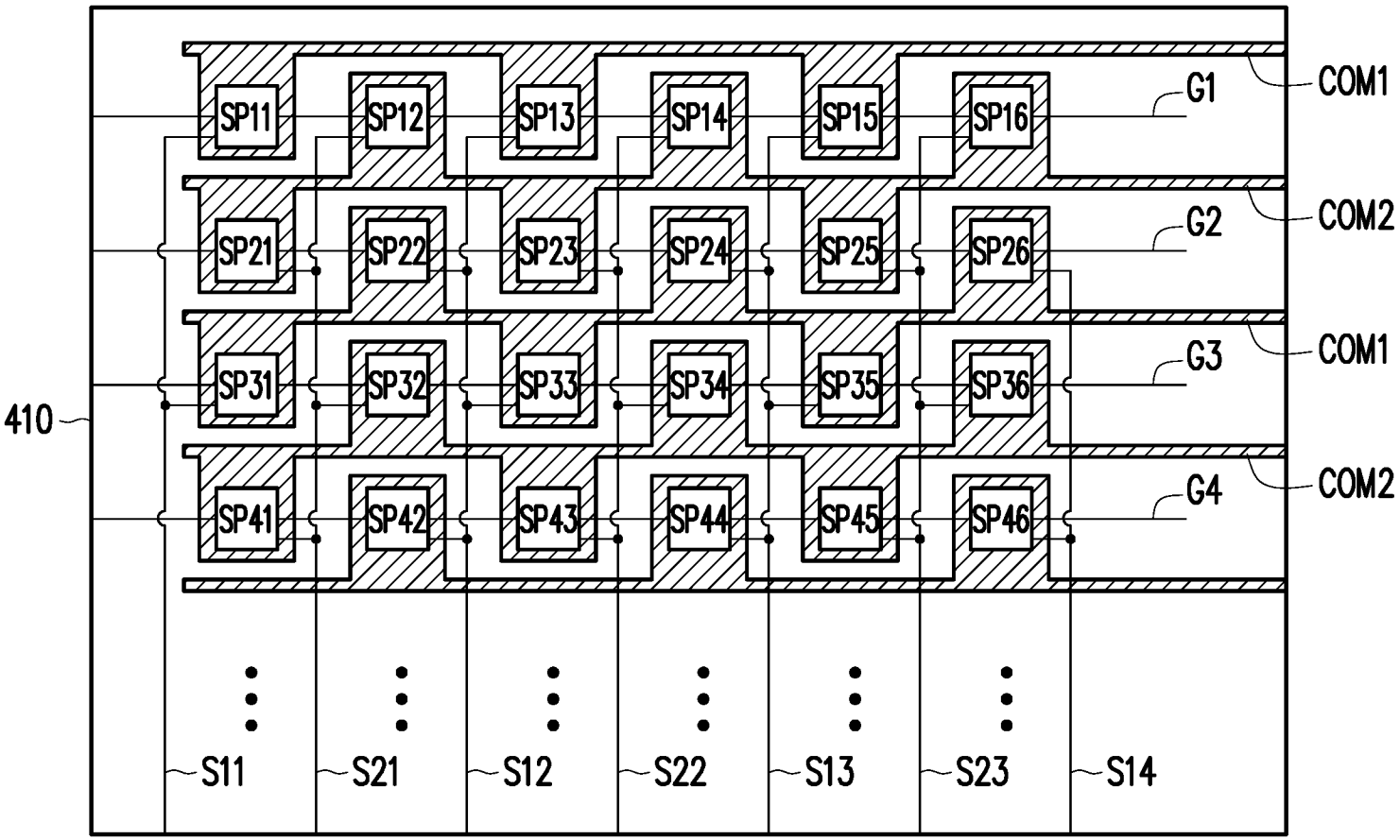
FIG. 7 is a schematic diagram of a display panel according to a fourth embodiment of the disclosure.

Please refer to FIG. 6 and FIG. 7 at the same time. FIG. 7 is a schematic diagram of a display panel according to the fourth embodiment of the disclosure. In the present embodiment, different from the display panel 310, the first common electrodes COM1 and the second common electrodes COM2 of a display panel 410 extend along the row direction. For example, the first subpixels SP11, SP13, S15 in a first-row subpixels collectively correspond to a single first common electrode COM1. the second subpixels SP12, SP14, S16 in the first-row subpixels and the second subpixels SP21, SP23, S25 in a second-row subpixels collectively correspond to a single second common electrode COM2. The first subpixels SP22, SP24, S26 in the second-row subpixels and the first subpixels SP31, SP33, S35 in a third-row subpixels collectively correspond to another single first common electrode COM1, and so on. However, the first common electrodes COM1 and the second common electrodes COM2 of the disclosure are not limited to the present embodiment. Similar to the embodiments of FIG. 5 and FIG. 6, the display panel 410 may also be driven based on the signal timing of FIG. 6, so as to implement the dot (subpixel) inversion driving with low power consumption.

In summary, according to the disclosure, to implement the dot inversion driving or the column inversion driving, the voltages of the first common electrodes and the second common electrodes only need to be converted once in a single frame time interval. In this way, the display device with better visual effects and low power consumption in inversion manners is provided in the disclosure.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A display device, comprising:

a display panel, comprising:

a plurality of scan lines;

a plurality of pixels, wherein a plurality of row pixels in the plurality of pixels respectively correspond to the plurality of scan lines;

a plurality of first common electrodes; and a plurality of second common electrodes, alternately arranged with the first common electrodes; and a driving circuit, coupled to the display panel, configured to:

sequentially provide, in a first time interval of a first frame period and a first time interval of a second frame period, scan signals to odd-row scan lines in the plurality of scan lines;

provide, in the first time interval of the first frame period and a second time interval of the second frame period, a first common voltage to the plurality of first common electrodes, and a second common voltage to the plurality of second common electrodes;

sequentially provide, in a second time interval of the first frame period and the second time interval of the second frame period, the scan signals to even-row scan lines in the plurality of scan lines; and provide, in the second time interval of the first frame period and the first time interval of the second frame period, the second common voltage to the plurality of first common electrodes, and the first common voltage to the plurality of second common electrodes, wherein the second common voltage is different from the first common voltage, and wherein the first time interval of the second frame period follows after the second time interval of the first frame period.

2. The display device according to claim 1, wherein:

each of the pixels comprise a plurality of subpixels, the first common electrodes respectively correspond to odd-column subpixels in the subpixels, and the second common electrodes respectively correspond to even-column subpixels in the subpixels.

3. The display device according to claim 2, wherein in a row direction, adjacent subpixels are respectively provided with a plurality of data signals having opposite polarities.

4. The display device according to claim 1, wherein the first common electrodes respectively correspond to odd-column pixels in the pixels, and the second common electrodes correspond to even-column pixels in the pixels.

5. The display device according to claim 4, wherein polarities of a plurality of data signals provided to the odd-column pixels in the pixels are opposite to polarities of a plurality of data signals provided to the even-column pixels in the pixels.

6. The display device according to claim 5, wherein:

each of the pixels comprise a plurality of subpixels, and in a row direction, the plurality of subpixels corresponding to the same pixel are provided with a plurality of data signals having the same polarities.

7. The display device according to claim 1, wherein:

each of the pixels comprise a plurality of subpixels, the first common electrodes correspond to a plurality of first subpixels in the subpixels, the second common electrodes correspond to the plurality of second subpixels in the subpixels, and the plurality of second subpixels are alternately arranged with the plurality of first subpixels in a row direction and a column direction.

8. A display device, comprising:

a display panel, comprising:

a plurality of scan lines;

a plurality of subpixels, wherein a plurality of row subpixels in the subpixels correspond to the plurality of scan lines;

a plurality of first data lines and a plurality of second data lines;

a plurality of first common electrodes, collectively corresponding, with the plurality of first data lines, to a plurality of first subpixels in the plurality of subpixels; and a plurality of second common electrodes, collectively corresponding, with the plurality of second data lines, to a plurality of second subpixels in the plurality of subpixels, wherein the second subpixels are alternately arranged with the first subpixels in a row direction and a column direction; and a driving circuit, coupled to the display panel, configured to:

sequentially provide, in a first frame period, a plurality of scan signals to the plurality of scan lines, a first common voltage to the plurality of first common electrodes, and a second common voltage to the plurality of second common electrodes; and sequentially provide, in a second frame period, the plurality of scan signals to the plurality of scan lines, the second common voltage to the plurality of first common electrodes, and the first common voltage to the plurality of second common electrodes, wherein the second common voltage is different from the first common voltage, wherein the plurality of second subpixels in a first-column subpixels and the plurality of second subpixels in a second-column subpixels collectively correspond to one of the plurality of second data lines, and wherein the plurality of first subpixels in the second-column subpixels and the plurality of first subpixels in a third-column subpixels collectively correspond to one of the plurality of first data lines.

9. The display device according to claim 8, wherein the first common electrodes and the second common electrodes extend along the column direction.

10. The display device according to claim 9, wherein:

the plurality of second subpixels in the first-column subpixels and the plurality of second subpixels in the second-column subpixels collectively correspond to one of the second common electrodes, and the plurality of first subpixels in the second-column subpixels and the plurality of first subpixels in the third-column subpixels collectively correspond to one of the first common electrodes.

11. The display device according to claim 8, wherein the first common electrodes and the second common electrodes extend along the row direction.

12. The display device according to claim 11, wherein:

the plurality of second subpixels in a first-row subpixels and the plurality of second subpixels in a second-row subpixels collectively correspond to one of the second common electrodes, the plurality of first subpixels in the second-row subpixels and the plurality of first subpixels in a third-row subpixels collectively correspond to one of the first common electrodes.

13. The display device according to claim 8, wherein polarities of a plurality of data signals respectively received by the plurality of first subpixels are opposite to the polarities of the plurality of data signals respectively received by the plurality of second subpixels.

* * * * *